US010864135B2

(12) United States Patent
Carlson

(10) Patent No.: US 10,864,135 B2
(45) Date of Patent: Dec. 15, 2020

(54) APPARATUS AND SYSTEM FOR MANIPULATING SOFT TISSUE

(71) Applicant: Thomas G. Carlson, Deer Mountain, UT (US)

(72) Inventor: Thomas G. Carlson, Deer Mountain, UT (US)

( * ) Notice: Subject to any disclaimer, the term of this patent is extended or adjusted under 35 U.S.C. 154(b) by 1432 days.

(21) Appl. No.: 13/936,761

(22) Filed: Jul. 8, 2013

(65) Prior Publication Data

US 2014/0012168 A1 Jan. 9, 2014

Related U.S. Application Data

(60) Provisional application No. 61/668,503, filed on Jul. 6, 2012, provisional application No. 61/735,228, filed on Dec. 10, 2012.

(51) Int. Cl.
*A61H 15/00* (2006.01)

(52) U.S. Cl.
CPC . *A61H 15/0092* (2013.01); *A61H 2015/0014* (2013.01); *A61H 2015/0035* (2013.01); *A61H 2015/0071* (2013.01); *A61H 2201/0207* (2013.01); *A61H 2201/0214* (2013.01); *A61H 2201/0257* (2013.01);
(Continued)

(58) Field of Classification Search
CPC .... A61H 2015/0007; A61H 2015/0014; A61H 2015/0021; A61H 2015/0028; A61H 2015/0035; A61H 2015/0042; A61H 2015/005; A61H 2015/0057; A61H 2015/0064; A61H 2015/0071;
(Continued)

(56) References Cited

U.S. PATENT DOCUMENTS 248,493 A * 10/1881 Moore ..... F24H 3/00 126/109
1,111,427 A 9/1914 Archibald
(Continued)

FOREIGN PATENT DOCUMENTS

CN 201389165 1/2010
CN 201399071 2/2010
(Continued)

OTHER PUBLICATIONS http://rumbleroller.com/index.html.

*Primary Examiner* — LaToya M Louis
(74) *Attorney, Agent, or Firm* — Thorpe North & Western, LLP

(57) ABSTRACT

An apparatus and system for manipulating soft tissue may include a support member and a raised member. The support member includes a support surface disposed between a first end of the support member and a second end of the support member. The support member is elongated in a lengthwise direction between the first end of the support member and the second end of the support member. The raised member includes an outer surf ace disposed opposite an inner surface. The inner surf ace is supportable by the support surface of the support member. The outer surf ace of the raised member is configured to rotate along at least a portion of a user's body in response to movement of the raised member along the user's body. The raised member is repositionable along the support surf ace of the support member in the lengthwise direction.

13 Claims, 11 Drawing Sheets

(52) U.S. Cl.
CPC ..... *A61H 2201/0278* (2013.01); *A61H 2201/0292* (2013.01); *A61H 2201/1253* (2013.01); *A61H 2201/1284* (2013.01); *A61H 2201/1695* (2013.01); *A61H 2205/081* (2013.01); *A61H 2205/10* (2013.01)

(58) Field of Classification Search
CPC ..... A61H 15/00; A61H 15/0078; A61H 15/0085; A61H 15/0092
See application file for complete search history.

(56) References Cited

U.S. PATENT DOCUMENTS 1,533,528 A * 4/1925 Weaver ..... A61H 15/0092 601/118
2,221,785 A * 11/1940 Douglas ..... A61H 15/0092 601/120
2,461,413 A * 2/1949 Dirand ..... A61H 15/0092 601/120
3,419,268 A * 12/1968 Bellet ..... A61H 15/00 482/132
3,664,334 A 5/1972 O'Neil
3,705,654 A 12/1972 Morini et al.
3,750,654 A 8/1973 Shui
4,807,603 A 2/1989 Yasui
4,945,900 A * 8/1990 Masuda ..... A61H 15/0092 601/120
5,170,778 A * 12/1992 Jamis ..... A61H 15/00 601/121
5,364,338 A * 11/1994 Terashima ..... A61H 15/0092 601/118
5,577,996 A * 11/1996 Gardner ..... A61H 15/0092 601/118
5,588,953 A * 12/1996 Chang ..... A61H 15/0092 601/120
5,824,013 A 10/1998 Allen
6,419,650 B1 7/2002 Ryan et al.
D492,791 S 7/2004 Alexander
6,974,427 B1 * 12/2005 Lapham ..... A61H 15/00 601/120
D527,831 S 9/2006 Hong
7,918,774 B2 4/2011 Dye
2005/0215928 A1 9/2005 Banks et al.
2006/0047181 A1 * 3/2006 Hsu ..... A61H 15/0085 600/38
2006/0235343 A1 * 10/2006 Fitzmaurice ..... A61H 15/0092 601/131
2007/0129654 A1 6/2007 Anderson, Jr.
2011/0172573 A1 7/2011 Wallace
2011/0245741 A1 * 10/2011 L'Homme ..... A61H 15/0085 601/120
2011/0313333 A1 * 12/2011 Nicholson ..... A61H 15/0092 601/120
2012/0059293 A1 * 3/2012 Collins ..... A61H 11/00 601/46

FOREIGN PATENT DOCUMENTS

DE 3905517 3/1990
WO WO03/006112 A2 1/2003
WO WO2010/076359 A1 7/2010

* cited by examiner

APPARATUS AND SYSTEM FOR MANIPULATING SOFT TISSUE

CROSS-REFERENCES TO RELATED APPLICATIONS

This application claims the benefit of U.S. Provisional Patent Application No. 61/668,503 entitled "APPARATUS AND SYSTEM FOR MANIPULATING SOFT TISSUE" and filed on Jul. 6, 2012 for Thomas Carlson, which is incorporated herein by reference. This application also claims the benefit of U.S. Provisional Patent Application No. 61/735,228 entitled "APPARATUS AND SYSTEM FOR MANIPULATING SOFT TISSUE" and filed on Dec. 10, 2012 for Thomas Carlson, which is incorporated herein by reference.

FIELD OF THE INVENTION

This subject matter relates to physical therapy, fitness, and self massage and more particularly relates to manual manipulation resulting in strengthening and the elongation of a user's muscles.

BACKGROUND

Individuals who participate in strenuous physical activity often incur injuries to their muscles and/or nervous system. Often, the injury involves tightening or swelling of the tissue surrounding the nerve (i.e., a "pinched nerve"). The tissue surrounding the nerve is typically, but not always, muscle tissue. A pinched nerve may result from compression, constriction, or stretching of the nerve. Pinched nerves can lead to peripheral neuropathy, mayofascial syndrome, carpal tunnel syndrome, tennis elbow, etc. Pinched nerves can occur anywhere in any soft tissue within an individual's body but a common complaint involves the user's spinal column or back. One treatment for muscle and nerve pain involves massaging the affected area to relax the muscles that may be pinching a nerve. Once the muscles relax, they release the nerve and the user enjoys some relief from the pain.

If the affected individual has a significant other, the significant other may provide the individual with a massage of the affected area. However, the significant other is typically not trained in massage therapy and therefore, the massage given by such an individual may be less than satisfactory or adequate. Accordingly, individuals with moderate to severe pain may be forced to visit a massage therapist or physical therapist to relieve their pain. The cost of receiving a massage can vary with prices ranging from as little as $30.00 per hour to as much as $150.00 per hour or more. Obviously, if the user requires repeat visits to a massage therapist, this form of relief can be cost prohibitive.

SUMMARY

From the foregoing discussion, it should be apparent that a need exists for an apparatus and system that manipulates a user's soft tissue. Beneficially, such an apparatus and system would be adjustable to target specific areas on the user's body and would involve a onetime cost of ownership.

The present invention has been developed in response to the present state of the art, and in particular, in response to the problems and needs in the art that have not yet been fully solved by currently available soft tissue manipulation devices. Accordingly, the present invention has been developed to provide an apparatus and system for manipulating soft tissue that overcome many or all of the above-discussed shortcomings in the art.

The apparatus for manipulating soft tissue, in certain embodiments, includes a support member and a raised member. The support member includes a support surface disposed between a first end of the support member and a second end of the support member. The support member is elongated in a lengthwise direction between the first end of the support member and the second end of the support member. The raised member includes an outer surface disposed opposite an inner surface. The inner surface is supportable by the support surface of the support member. The outer surface of the raised member is configured to rotate along at least a portion of a user's body in response to movement of the raised member along the user's body. The raised member is repositionable along the support surface of the support member in the lengthwise direction between the first end of the support member and the second end of the support member.

In one embodiment, the support surface includes at least one engagement element and the inner surface of the raised member includes at least one stopping element. The at least one engagement element is an element selected from a groove and a detent ball. The at least one stopping element is selected from the other of the groove and the detent ball. The detent ball is engageable with the groove to maintain the raised member in a discrete position along the support member.

The support member, in one embodiment, is a substantially cylindrical tube extending in the lengthwise direction. The cylindrical tube includes a plurality of circumferential grooves disposed about the support surface of the support member. Each groove is engageable with at least one detent ball positioned within the inner surface of the raised member. Engagement between the at least one detent ball and one of the circumferential grooves disposed about the support surface of the support member maintains the raised member in a discrete position along the support member.

In certain embodiments, the raised member is repositionable along the support surface of the support member to engage the at least one detent ball with a second groove disposed about the support surface of the support member. Engagement between the at least one detent ball and the second groove disposed about the support surface of the support member maintains the raised member in a second discrete position along the support member.

In other embodiments, the support member is a substantially cylindrical tube extending in the lengthwise direction and the cylindrical tube including a plurality of detent balls disposed on the support surface of the support member. In such an embodiment, each detent ball is engageable with a groove disposed within the inner surface of the raised member. Engagement between at least one detent ball and the groove disposed within the inner surface of the raised member maintains the raised member in a discrete position along the support member.

In another embodiment, the raised member is repositionable along the support surface of the support member to engage a second detent ball with the groove disposed within the inner surface of the raised member. Again, in this embodiment, engagement between the second detent ball and the groove disposed within the inner surface of the raised member maintains the raised member in a second discrete position along the support member.

The raised member, in one embodiment, is a first raised member and the apparatus further includes a second raised member. In such an embodiment, the second raised member has an outer surface disposed opposite an inner surface. The inner surface of the second raised member is supportable by the support surface of the support member. The outer surface of the second raised member has a diameter substantially larger than a diameter of the outer surface of the first raised member. In certain embodiments, the first raised member and the second raised member are independently repositionable along the support surface of the support member in the lengthwise direction.

In another embodiment, the first raised member encircles the support surface of the support member and extends axially away from the support surface of the support member. In such an embodiment, the second raised member also encircles the support surface of the support member and extends axially away from the support surface of the support member.

BRIEF DESCRIPTION OF THE DRAWINGS

In order that the advantages of the subject matter will be readily understood, a description of the subject matter will be rendered by reference to specific embodiments that are illustrated in the appended drawings. Understanding that these drawings depict only typical embodiments of the subject matter and are not therefore to be considered to be limiting of its scope, the subject matter will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment.

Furthermore, the described features, structures, or characteristics of the subject matter may be combined in any suitable manner in one or more embodiments. In the following description, numerous specific details are provided for a thorough understanding of embodiments of the subject matter. One skilled in the relevant art will recognize, however, that the subject matter may be practiced without one or more of the specific details, or with other methods, components, materials, and so forth. In other instances, well-known structures, materials, or operations are not shown or described in detail to avoid obscuring aspects of the subject matter.

Figure 1:
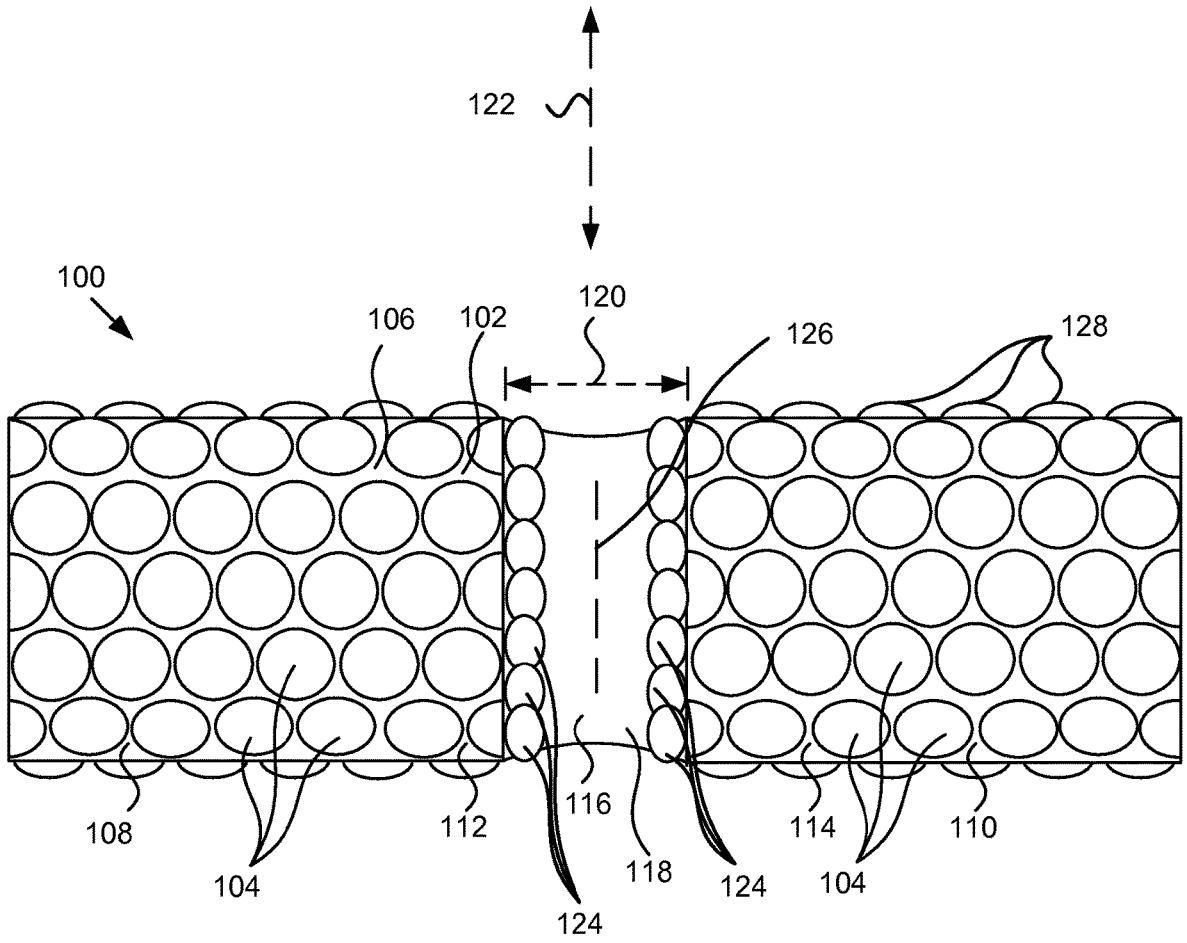
FIG. 1 depicts a side view of one embodiment of an apparatus for manipulating soft tissue in accordance with the present subject matter.

FIG. 1 depicts a side view of one embodiment of an apparatus 100 for manipulating soft tissue. The apparatus 100, in certain embodiments, includes a support member 102 and a plurality of nodules 104 extending from an outer surface 106 of the support member 102.

In one embodiment, the support member 102 includes a first substantially cylindrical end section 108 and a second substantially cylindrical end section 110. The first substantially cylindrical end section 108 has a first outer surface 112 of a first diameter. The second substantially cylindrical end section 110 has a second outer surface 114 of a second diameter. In certain embodiments, the diameter of the first substantially cylindrical end section 108 (the first diameter) is approximately the same size as the diameter of the second substantially cylindrical end section 110 (the second diameter).

A channel 116 is disposed between the first substantially cylindrical end section 108 and the second substantially cylindrical end section 110. In one embodiment, the channel has an outer surface 118 of a third diameter. In such an embodiment, the third diameter may be smaller than the first diameter and the second diameter. Thus, in one embodiment, the end sections 108 and 110 are substantially larger in diameter than the channel 116.

In one embodiment, the apparatus 100 may be used to manipulate the soft tissues of a user's back. In such an embodiment, the larger diameter end sections 108 and 110 provide support to the relatively large muscle areas on each side of a user's spinal column.

The channel 116, in certain embodiments, reduces or eliminates pressure placed on the user's spinal column to insure that the user's tender spinal column is not irritated or injured by the apparatus 100. Accordingly, the channel 116, in certain embodiments, may be sized to accommodate a user's spinal column. Thus, a width 120 of the channel 118 may be of a sufficient length to accommodate an average user's spinal column. In one embodiment, the width 120 of the channel 118 may be between about one (1) to about two (2) inches.

A depth of the channel is defined by a difference between the diameter of the outer surface 118 of the channel 116 (the third diameter) and the diameter of the outer surfaces 112, 114 of the first and second end sections 108, 100 (the first and second diameters). In certain embodiments, the depth of the channel 116 may be between about three quarters (0.75) of an inch and one and a half (1.5) inches.

In one embodiment, the channel 116 is positioned at approximately the longitudinal center 126 of the support member 102 and extends on either side of the longitudinal center 126 of the support member 102 a sufficient distance to receive a user's spinal column. In other embodiments, the channel 116 may be positioned in an area other than the longitudinal center 126 of the support member 102 (i.e., closer to one end or the other of the support member 102).

In certain embodiments, the first outer surface 112 of the first substantially cylindrical end section 108 includes a plurality of nodules 104. Similarly, the second outer surface 114 of the second substantially cylindrical end section 110 includes a plurality of nodules 104. The channel 116, in one embodiment, includes an area in the longitudinal center 126 of the apparatus 100 which is substantially free from nodules 104.

The nodules 104 extend axially away from the first outer surface 112 of the first substantially cylindrical end section 108 and the second outer surface 114 of the second substantially cylindrical end section 110. In the embodiment illustrated in FIG. 1, the nodules 104 have a partial spherical shape. That is, in certain embodiments, an outer surface 128 of each nodule 104 has a partial spherical shape that extends away from the support member 102. In other embodiments, the nodules 104 may have another shape (i.e., triangles, pyramids, squares, circles, etc.) that extend axially away from the first and second outer surfaces 112, 114 of the first and second substantially cylindrical end sections 108, 110 respectively.

In use, the nodules 104 provide a massaging effect when the user positions a body part on the apparatus 100. For example, in one instance, a user may position the apparatus 100 on the ground or other supportive surface. The user may then position his/her back on the apparatus 100 such that the user's spinal column is received within the channel 116. From this position, the user may move his/her back in the direction indicated by arrow 122 to massage the soft tissue of the user's back. The nodules 104 provide pressure to create a massaging effect on the user's back.

While the embodiment described above discusses the use of the apparatus 100 to massage a user's back, one of skill in the art will recognize that the apparatus 100 may be used to massage other areas on a user's body. For example, in one embodiment, the user may position his/her leg on the apparatus and move their leg in the direction indicated by arrow 122 to massage the user's leg. Similarly, other body parts may be positioned on the apparatus 100 to massage these other body parts.

In one embodiment, the channel 116 may include a plurality of massaging protrusions 124 disposed about the circumference of the outer surface 118 of the channel 116 at each side of the channel 116. The extensions, in one embodiment, extend axially away from the outer surface 118 of the channel 116. In such an embodiment, the protrusions 124 may be positioned on either side of the user's spinal column to massage the user's spinal column as the user moves his/her back in the direction indicated by arrow 122. As depicted, the protrusions 124 are elongated and rounded. In other embodiments, the protrusions 124 may have any other shape that extends axially away from the outer surface 118 of the channel 116. In yet another embodiment, the channel 116 may be substantially free of protrusions 124 or any other extensions that extend from the outer surface 118 of the channel 116.

Figure 2:
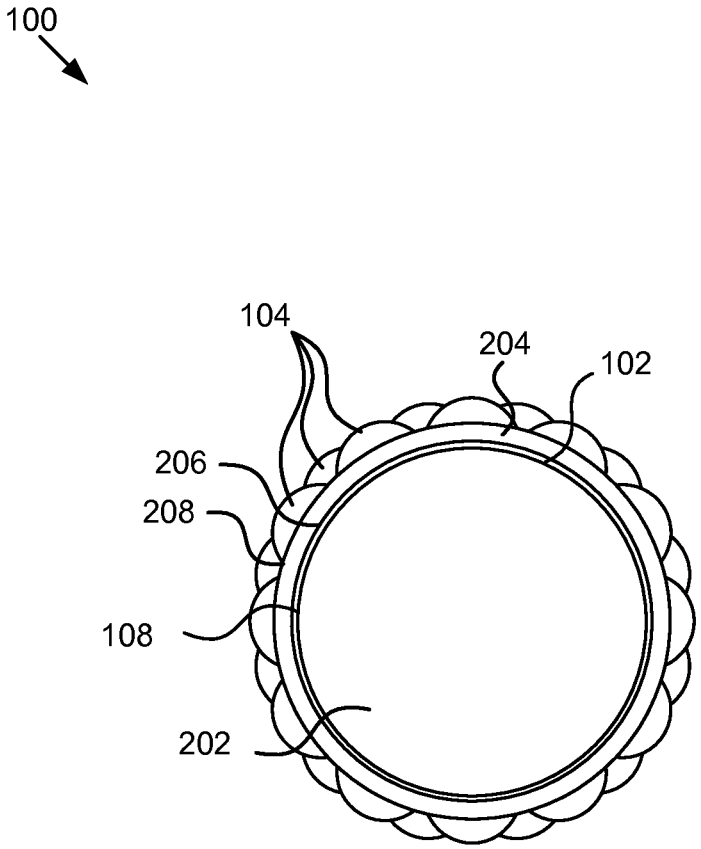
FIG. 2 depicts an end view of one embodiment of an apparatus for manipulating soft tissue in accordance with the present subject matter.

FIG. 2 depicts an end view of one embodiment of an apparatus 100 for manipulating soft tissue. In the embodiment illustrated in FIG. 2, the first substantially cylindrical end sections 108 can be seen with the second substantially cylindrical end section 110 being positioned behind the first substantially cylindrical end section 108 and out of view.

In certain embodiments, the first substantially cylindrical end section 108, the second substantially cylindrical end section 110 and the channel 116 may be hollow such that a void 202 extends all the way through the support member 102 from the first substantially cylindrical support end section 108 to the second substantially cylindrical end section 110. In such an embodiment, a vibrating mechanism (not shown) may be positioned within the void 202 in the support member 102. The vibrating mechanism imparts a vibratory motion to the apparatus 100 to aid in massaging the user's soft tissue.

In one embodiment, the apparatus 100 includes a layer of semi-rigid material 204 disposed about the support member 102. In such an embodiment, the layer of semi-rigid material includes an adhering surface 206 and an exterior surface 208. The adhering surface 206 encircles the support member 102. In one embodiment, the plurality of nodules 104 extend axially from the exterior surface 208 of the layer of semi-rigid material 204.

Figure 3:
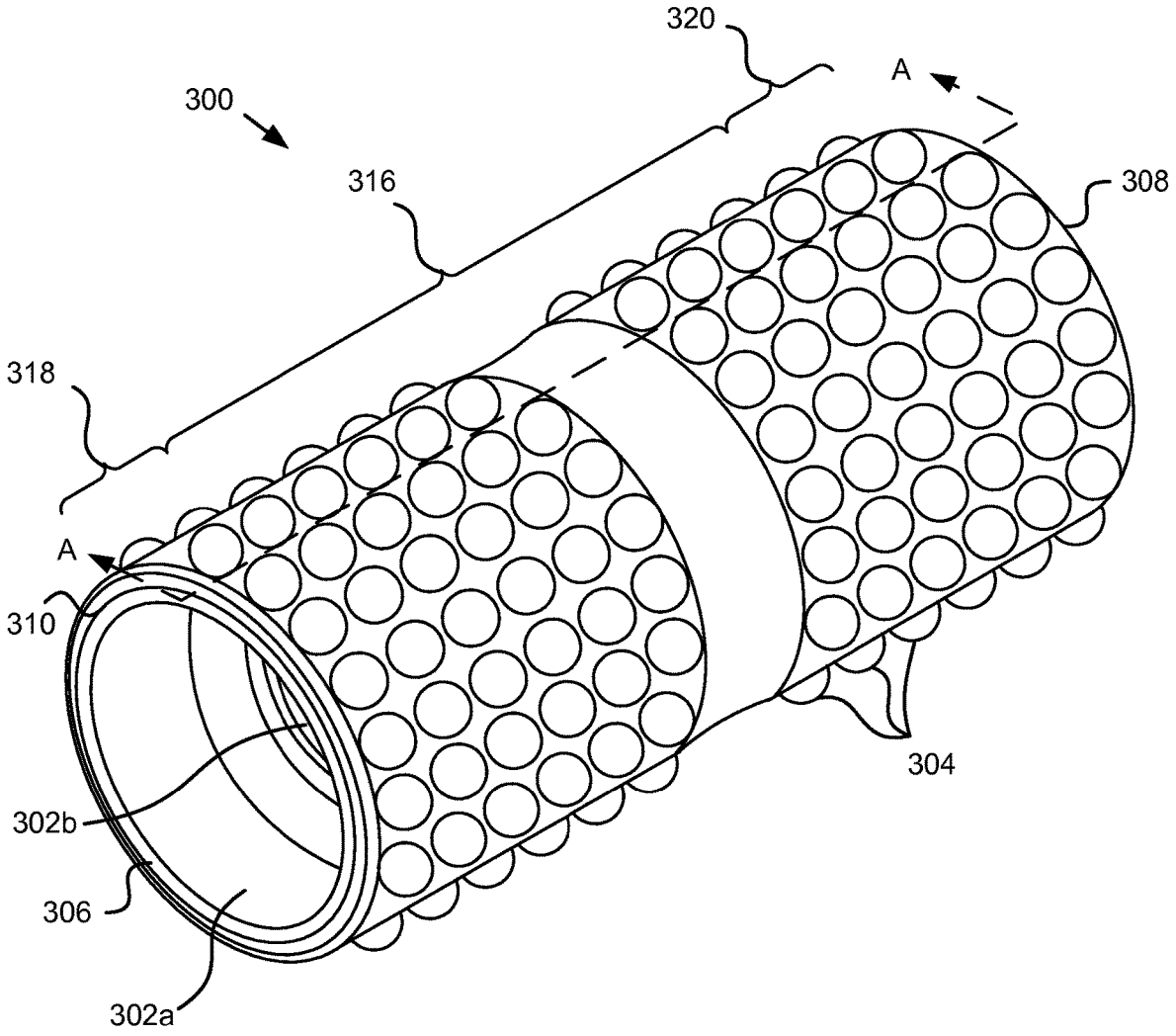
FIG. 3 depicts a perspective view of one embodiment of an apparatus for manipulating soft tissue in accordance with the present subject matter.
Figure 4:
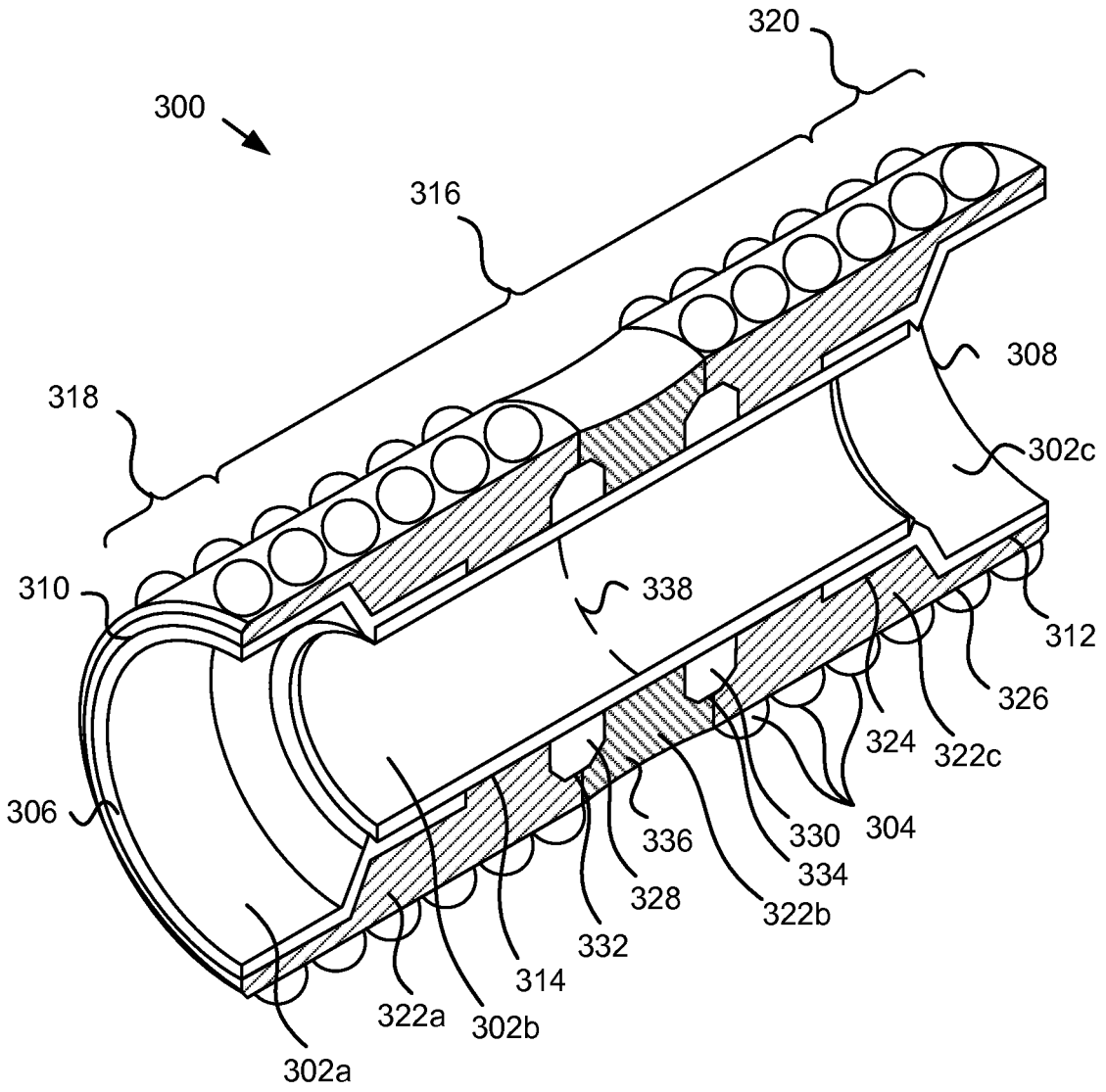
FIG. 4 depicts a cutaway perspective view of one embodiment of the apparatus for manipulating soft tissue in accordance with the present subject matter.

FIG. 3 depicts a perspective view of one embodiment of an apparatus 300 for manipulating soft tissue. FIG. 4 depicts a cutaway perspective view of one embodiment of the apparatus 300 for manipulating soft tissue. The embodiment illustrated in FIG. 4 is taken along line A-A of FIG. 3.

With reference to both FIG. 3 and FIG. 4, in certain embodiments, the apparatus 300 includes a support member 302 and a plurality of nodules 304 extending axially away from the support member 302. As can be more clearly seen in FIG. 4, in certain embodiments, the support member 302 includes a plurality of sections, a first substantially cylindrical end section **302*a*, a second substantially cylindrical end section 302*c* and a channel 302*b* disposed between the first substantially cylindrical end section 302*a* and the second substantially cylindrical end section 302*c***.

In certain embodiments, the first substantially cylindrical end section **302*a* has a first outer surface 310 of a first diameter and the second substantially cylindrical end section 302*c* has a second outer surface 312 of a second diameter. In one embodiment, the first outer surface 310 of the first substantially cylindrical end section 302*a* has a diameter approximately the same as the diameter of the second outer surface 312 of the second substantially cylindrical end section 302*c***.

In one embodiment, the channel **302*b* is substantially cylindrical and has an outer surface 314 of a third diameter. The diameter of the outer surface 314 of the channel 302*b* (the third diameter) is smaller than the diameter of the first outer surface 310 of the first substantially cylindrical end section 302*a* (the first diameter) and the diameter of the second outer surface 312 of the second substantially cylindrical end section 302*c* (the second diameter). Thus, in certain embodiment, the center area 316 of the support member 302 has a reduced diameter in comparison with the end areas 318 and 320 of the support member 302**.

In one embodiment, the first substantially cylindrical end section **302*a* and the second substantially cylindrical end section 302*c* may be a conventional pipe reducer as is known in the art. For example, in one embodiment, the first substantially cylindrical end section 302*a* and the second substantially cylindrical end section 302*c* may be an Acrylonitrile Butadiene Styrene ("ABS") plastic pipe reducer. In certain embodiments the diameter of the first outer surface 310 of the first substantially cylindrical end section 302*a* (the first diameter) and the diameter of the second outer surface 312 of the second substantially cylindrical end section 302*c* (the second diameter) may be approximately four (4) inches. In other embodiments, the diameter of the first outer surface 310 of the first substantially cylindrical end section 302***a* (the first diameter) and the diameter of the second outer surface 312 of the second substantially cylindrical end section 302*c* (the second diameter) may be larger or smaller than four (4) inches.

Similarly, in certain embodiments, the channel 302*c* may also be made of a conventional ABS pipe piece. In one embodiment, the outer surface 314 of the channel 302*c* may have a diameter of about two (2) inches. In other embodiments, the outer surface 314 of the channel 302*c* may have a diameter of greater than or less than about two (2) inches. In other embodiments, the entire support member 302 may be made of a single unitarily molded piece of material.

In one embodiment, the entire length of the support member 302 may be approximately eleven and one-half (11.5) inches. In other embodiments, the entire length of the support member 302 may be greater than or less than about eleven and one-half (11.5) inches.

In certain embodiments, the nodules 304 extend axially away from the first outer surface 310 of the first substantially cylindrical end section 302*a* the second outer surface 312 of the second substantially cylindrical end section 302*c*. In another embodiment, the nodules 304 may also extend axially away from the outer surface 314 of the channel 302*b*.

In an exemplary embodiment, the apparatus 300 includes a layer of semi-rigid material 322 positioned around the support member 302. In the layer of semi-rigid material 322 includes an adhering surface 324 and an exterior surface 326. In such an embodiment. The adhering surface 324 encircles the support member 302 and the plurality of nodules 304 extend axially away from the exterior surface 326 of the layer of semi-rigid material 322.

In one embodiment, the layer of semi-rigid material 322 is a material selected to have a compression resistance sufficient to support a user without compressing to the support member 302. In certain embodiments, the layer of semi-rigid material 322 may include a plurality of cushioning sections 322*a*, 322*b*, and 322*c*. In such an embodiment, each cushioning section 322*a*, 322*b*, and 322*c* may have a different compression resistance.

In another embodiment, two or more of the cushioning sections 322*a*-322*c* may have the same compression resistance. For example, in one embodiment, cushioning section 322*a* and cushioning section 322*c* may have the same compression resistance and cushioning section 322*b* may have a different compression resistance. In such an embodiment, the compression resistance of cushioning section 322*b* may be selected such that the area covered by cushioning section 322*b* is softer to provide a softer area where a user's spine will typically rest.

In certain embodiments, the apparatus 300 includes a first raised portion 328 and a second raised portion 330. The first raised portion 328 is positioned between the first end section 302*a* and the second end section 302*c*. The second raised portion 330 is positioned between the first raised portion 328 and the second end portion 302*c*. The first raised portion 328 has an outermost surface 332 of a fourth diameter and the second raised portion 330 has an outermost surface 334 of a fifth diameter. In such an embodiment, the fourth diameter and the fifth diameter are larger than the third diameter (i.e., the diameter of the outer surface 314 of the channel 302*c*).

In one embodiment, the area between the first raised portion 328 and the second raised portion 330 define a spinal column receiving channel 336. In such an embodiment, the distance between the first raised portion 328 and the second raised portion 330 is sufficient to receive a user's spinal column. In one embodiment, the distance between the first raised portion 328 and the second raised portion 330 is approximately about one (1) to about two (2) inches.

In the embodiment illustrated in FIG. 4, the spinal column receiving channel 336 is disposed in the longitudinal center of the support member 302 as illustrated by dashed line 338. In other embodiments, the spinal column receiving channel 336 may be positioned closer to the first end 306 or the second end 308 of the support member 302.

Figure 5:
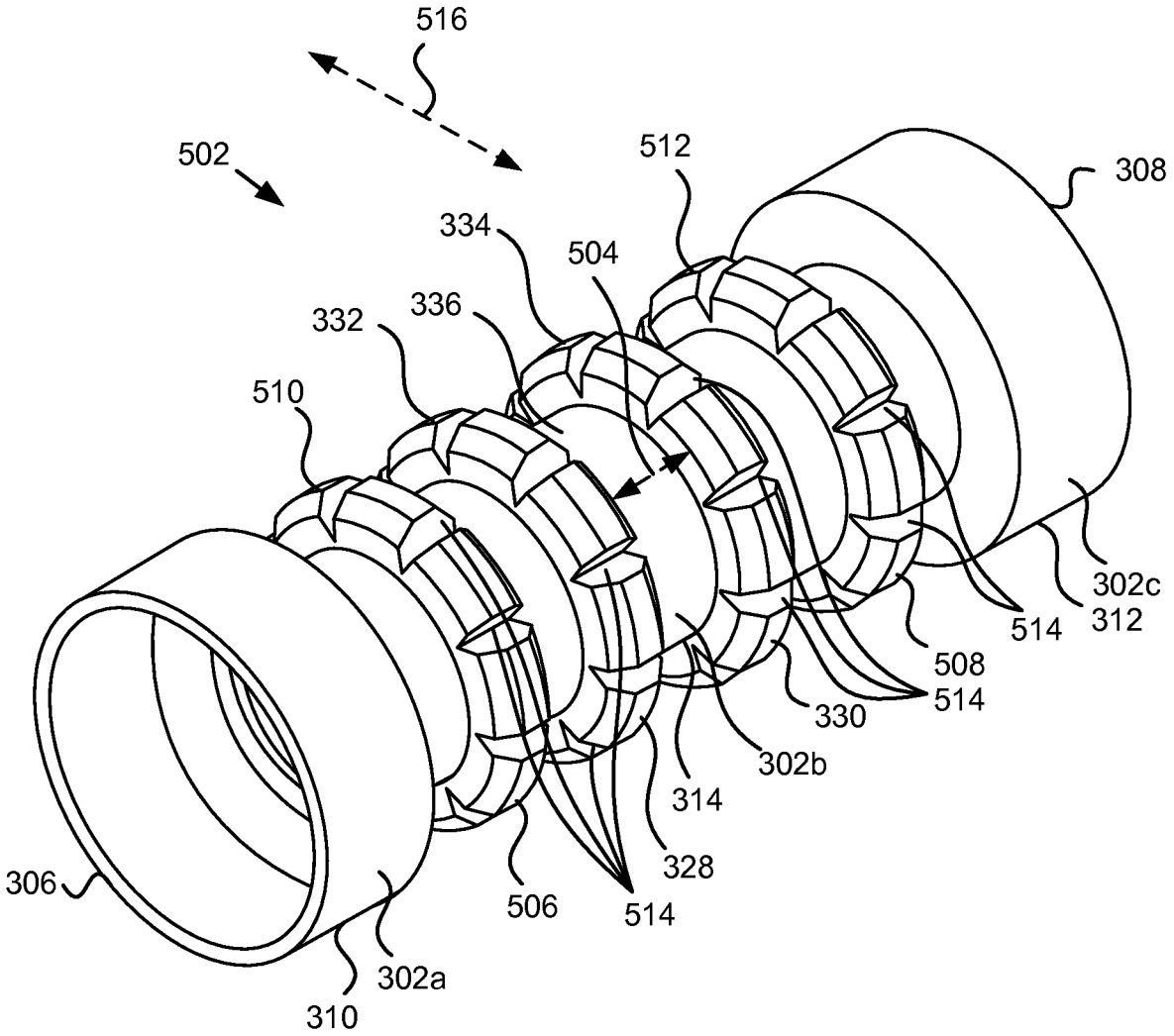
FIG. 5 depicts a perspective view of one embodiment of a support member for manipulating soft tissue in accordance with the present subject matter.

FIG. 5 depicts a perspective view of one embodiment of a support member 500 for manipulating soft tissue. In the embodiment illustrated in FIG. 5, the layer of semi-rigid material has been removed for clarity.

The support member 500 depicted in FIG. 5 includes many features analogous to the support member 302 discussed above with reference to FIG. 3 and FIG. 4. Accordingly, in certain embodiments, the support member 502 has a first end 306 positioned opposite a second end 308. The support member 502 also includes a first substantially cylindrical end section 302*a* and a second substantially cylindrical end section 302*c* with a channel 302*b* extending between the first substantially cylindrical end section 302*a* and the second substantially cylindrical end section 302*c*.

The first outer surface 310 of the first substantially cylindrical end section 302*a* and the second outer surface 312 of the second substantially cylindrical end section 302*c* have diameters (the first and second diameters) that are substantially larger than a diameter of an outer surface 314 (the third diameter) of the channel 302*b*.

In certain embodiments, a first raised portion 328 is positioned between the first substantially cylindrical end section 302*a* and the second substantially cylindrical end section 302*c*. A second raised portion 330 is positioned between the first raised portion 328 and the second substantially cylindrical end section 302*c*. In one embodiment, the first and second raised portions, 328 and 330 respectively, are positioned around the channel 302*b*. In other embodiments, the channel 302*b* may be molded to include the first and second raised portions, 328 and 330 respectively.

The first raised portion 328 has an outermost surface 332 of a fourth diameter and the second raised portion 330 has an outermost surface 334 of a fifth diameter. The fourth diameter (the diameter of the outermost surface 332 of the first raised portion 328) and the fifth diameter (the diameter of the outermost surface 334 of the second raised portion 330) are larger than the third diameter (the diameter of the outer surface 314 of the channel 302*b*.

In one embodiment, the area between the first raised portion 328 and the second raised portion 330 define a spinal column receiving channel 336. In such an embodiment, a distance between the first raised portion 328 and the second raised portion 330, as represented by arrow 504, is sufficient to receive a user's spinal column (i.e., between about one (1) inch and about two (2) inches.)

In certain embodiments, a third raised portion 506 is positioned between the first substantially cylindrical end section 302*a* and the first raised portion 328 and a fourth raised portion 508 is positioned between the second raised portion 330 and the second substantially cylindrical end section 302*c*. In such an embodiment, the third raised portion 506 has an outermost surface 510 of a sixth diameter and the fourth raised portion 508 has an outermost surface 512 of a seventh diameter. In one embodiment, the sixth diameter (the diameter of the outermost surface 510 of the third raised portion 506) and the seventh diameter (the diameter of the outermost surface 512 of the fourth raised portion 508) are approximately a same diameter as the fourth diameter (the diameter of the outermost surface 332 of the first raised portion 328) and the fifth diameter (the diameter of the second raised portion 330). In other embodiments, the fourth, fifth, sixth, and seventh diameters may be varied across the support member 502. In either embodiment, the fourth, fifth, sixth, and seventh diameters are typically larger than the third diameter (the diameter of the outer surface 314 of the channel 302*b*.)

The first, second, third, and fourth raised portions, 328, 330, 506, and 508 respectively, and the outer surface 314 of the channel 302*b* create a series of peaks and valleys for adding pressure to specific areas on a user's body. In certain embodiments, the first, second, third, and fourth raised portions, 328, 330, 506, and 508 respectively, may include a plurality of voids 514 extending longitudinally across each of the first, second, third, and fourth raised portions, 328, 330, 506, and 508 respectively. The voids 514 and the outermost surfaces 332, 334, 510, and 512 of the first, second, third, and fourth raised portions, 328, 330, 506, and 508 respectively, also create a series of peaks and valleys for adding pressure to specific areas on a user's body to create a massaging effect as the user rolls across the support member 502 in the direction indicated by arrow 516.

Figure 6:
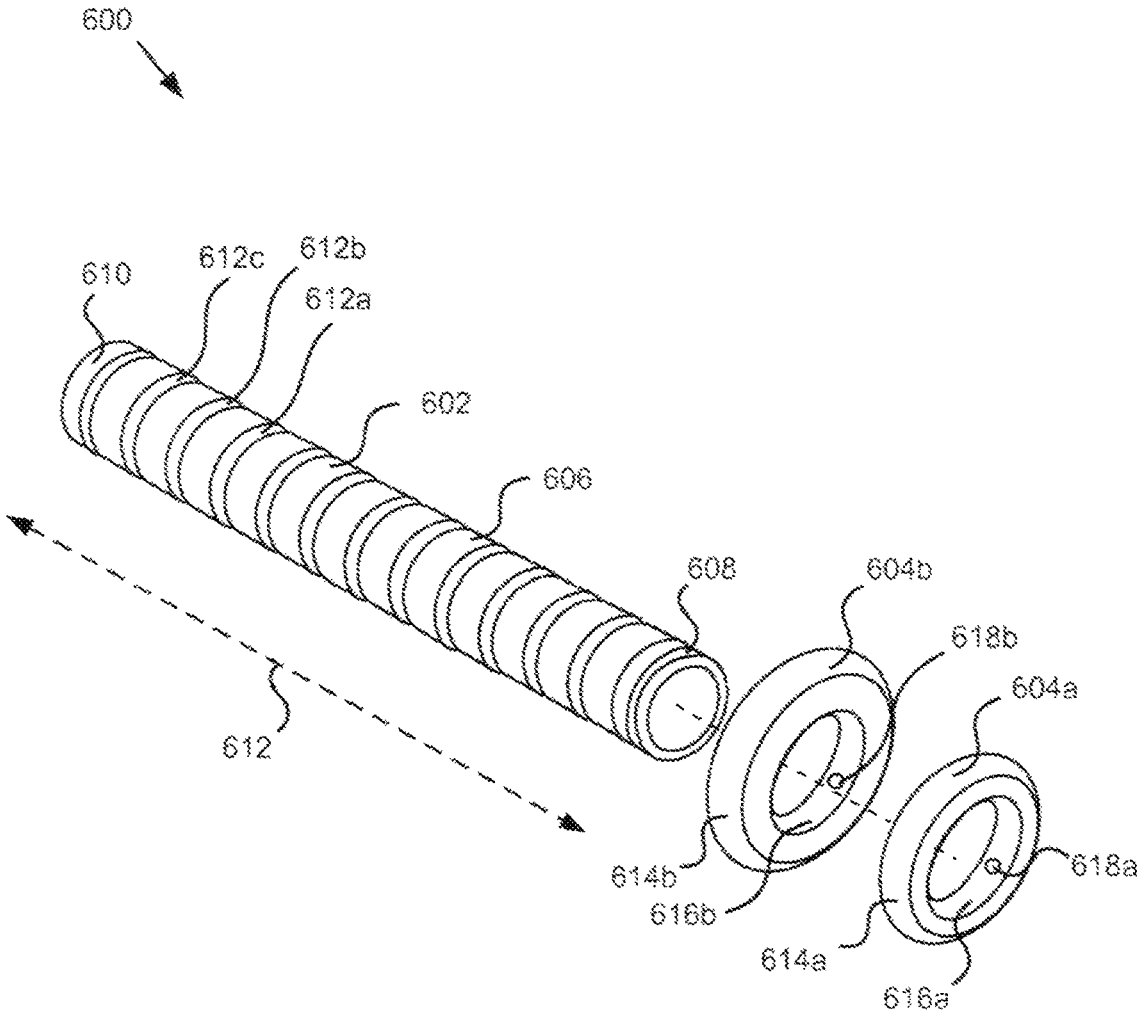
FIG. 6 depicts a perspective view of one embodiment of an apparatus for manipulating soft tissue in accordance with the present subject matter.
Figure 7:
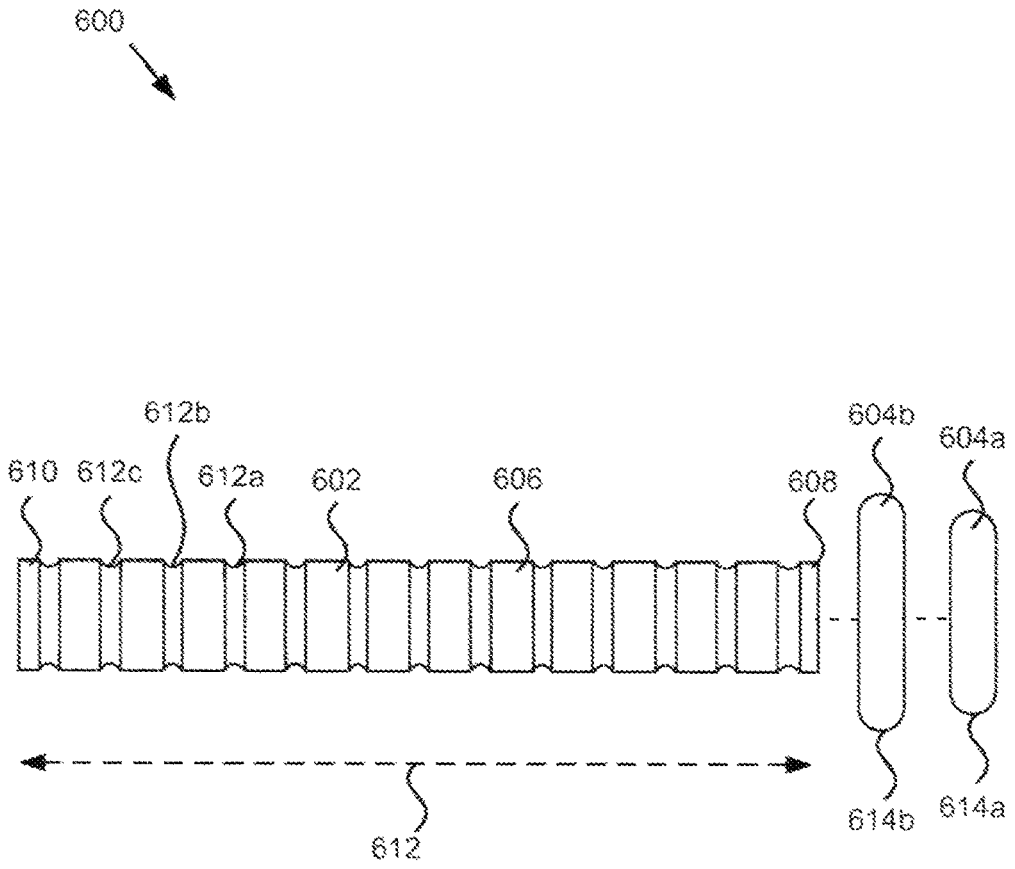
FIG. 7 depicts a side view of the apparatus for manipulating soft tissue depicted in FIG. 6 in accordance with the present subject matter.

FIG. 6 depicts a perspective view of one embodiment of an apparatus 600 for manipulating soft tissue in accordance with the present subject matter. FIG. 7 depicts a side view of the apparatus 600 for manipulating soft tissue depicted in FIG. 6. In certain embodiments, the apparatus 600 includes a support member 602 and at least one raised member 604*a* and 604*b* (collectively raised member 604).

The support member 602, in one embodiment, includes a support surface 606 that runs from a first end 608 of the support member 602 to a second end 610 of the support member 602. In certain embodiments, the support member 602 is elongated in a lengthwise direction (i.e., in the direction indicated by arrow 612) between the first end 608 of the support member 602 and the second end 610 of the support member 602.

Each raised member 604 includes an outer surface 614 positioned opposite an inner surface 616. For example, the first raised member 604*a* has an outer surface 614*a* that is positioned opposite the inner surface 616*a* of the first raised member 604*a*. Similarly, the second raised member 604*b* has an outer surface 614*b* that is positioned opposite the inner surface 616*b* of the second raised member 604*b*. As used herein the inner surfaces 616*a* and 616*b* are collectively referred to as inner surface 616 or inner surfaces 616 and the outer surfaces 614*a* and 614*b* are collectively referred to as outer surface 616 or outer surfaces 616. While the embodiments illustrated in FIGS. 6 and 7 only depict two raised members 604, one of skill in the art will recognize that in other embodiments the apparatus may include multiple raised members 604.

The inner surfaces 614 of the raised members 604 are supportable by the support surface 606 of the support member 602. The outer surfaces 616 of the raised members 604 are configured to rotate along at least a portion of a user's body in response to movement of the raised member 604 along the user's body. In one embodiment, the raised member or members 604 are repositionable along the support surface 606 of the support member 602 in the lengthwise direction 612 between the first end 608 of the support member 602 and second end 610 of the support member 602. In this manner, the massaging characteristics of the apparatus 600 can be customized based on the needs or desires of the user. For example, in one embodiment, the raised members 604 may be positioned along the support member 602 such that they only contact muscle groups that need massaging. In other embodiments, the raised members 604 may be repositioned such that they avoid contact with a particularly sore muscle group. One of skill in the art will recognize other arrangements of the raised members 604 may be used depending on the needs or desires of the user.

In certain embodiments, the support surface 606 of the support member 602 includes at least one engagement element 612*a*-612*c* (collectively engagement element or elements 612). The inner surfaces 616 of the raised members 604 includes at least one stopping element 618*a* and 618*b* (collectively stopping element(s) 618). In the embodiment illustrated in FIGS. 6, 7 and 8, the at least one engagement element 612 is a circumferential groove disposed about the support surface 606 of the support member 602. Similarly, in the embodiments illustrated in FIGS. 6, 7, and 8, the at least one stopping element 618 is a detent ball positioned within the inner surface 616 of the raised element 604. The stopping element 618 (the detent ball) is engageable with the engagement element 612 (the circumferential groove) to maintain the raised member 604 in a discrete position along the support member 602.

Figure 8:
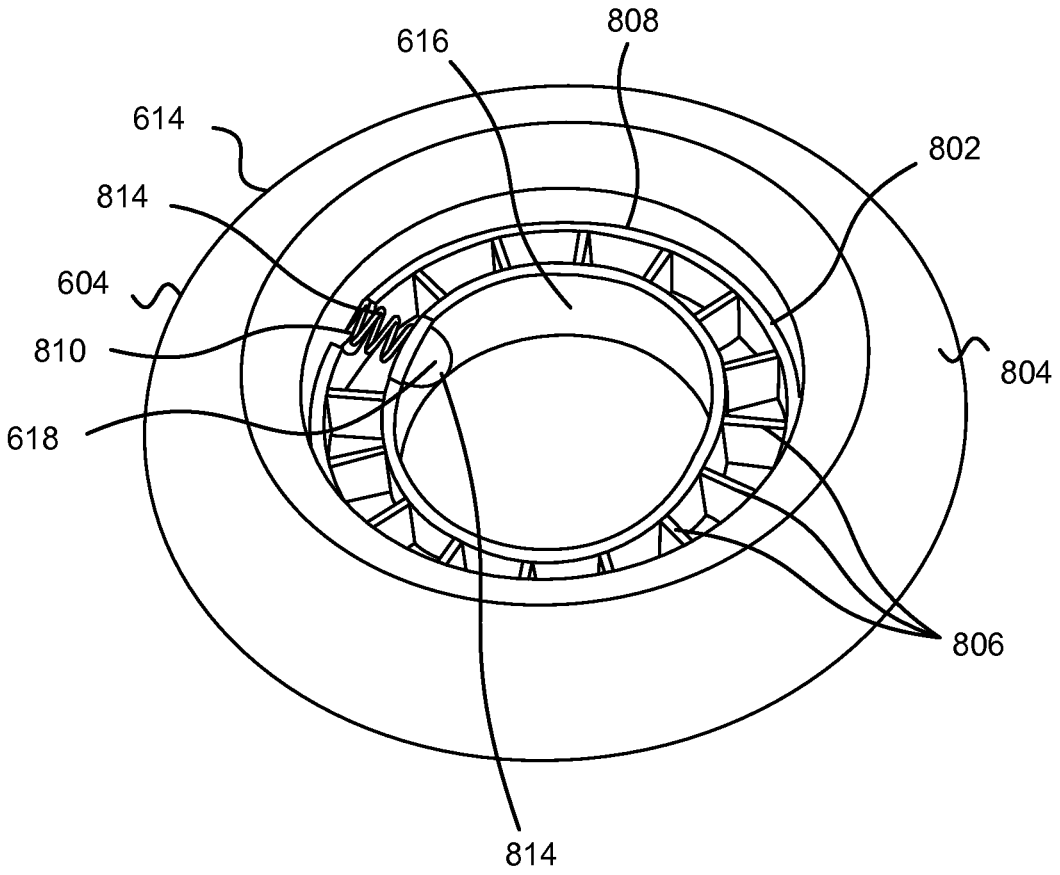
FIG. 8 depicts a perspective view of one embodiment of a raised member in accordance with the present subject matter.

While the embodiments illustrated in FIGS. 6 and 8 depict the raised member 604 as including a single stopping element 618 (the detent balls), one of skill in the art will recognize that in other embodiments, the raised members 604 may include more than one stopping element 618. For example, in one embodiment, each raised member 604 may include at least two stopping elements 618 (detent balls), with each stopping element position opposite one another within the inner surface 616 of the raised member 604. In such an embodiment, the opposing detent balls may operate to more securely engage the engagement elements 612 on the support surface 606 of the support member 602.

In the embodiment illustrated in FIGS. 6 and 7, the support member 602 is a substantially cylindrical tube extending in the lengthwise direction 612. In other embodiments, the support member 602 may have any other cross-sectional geometric shape. For example, in one embodiment, the support member 602 may have a hexagonal or octagonal cross-sectional shape. One of skill in the art will recognize other cross-sectional that may be used as the cross-sectional shape of the support member 602.

In an exemplary embodiment, the cylindrical tube of the support member 602 includes a plurality of circumferential grooves (the engagement elements 612) disposed about the support surface 606 of the support member 602. Each groove is engageable with at least one detent ball (the stopping elements 618) positioned within the inner surface 616 of the raised member 604. Engagement between the at least one detent ball (the stopping elements 618) and one of the circumferential grooves disposed about the support surface 606 of the support member 602 (i.e., the engagement elements 612) maintains the raised member 604 in a discrete position along the support member 602.

In certain embodiments, the raised member 604 is repositionable along the support surface 606 of the support member 602 to engage the at least one detent ball (the stopping elements 618) with a second groove (a second engagement element 612) disposed about the support surface 606 of the support member 602. In such an embodiment, engagement between the at least one detent ball (the stopping elements 618) and the second groove disposed about the support surface 606 of the support member 602 (i.e., the second engagement element 612) maintains the raised member 604 in a second discrete position along the support member 602.

For example in one embodiment, the first raised member 604*a* may be positioned on the support member 602 such that the stopping element 618*a* (the detent ball) engages the engagement element 612*a* (the circumferential groove disposed about the support surface 606 of the support member 602). In this position, the engagement between the stopping element 618*a* and the engagement element 612*a* operates to maintain the first raised member 604*a* in an area substantially above the engagement element 612*a* on the support surface 606 of the support member 602. If the first raised member 604*a* is repositioned over a second engagement element 612 (i.e., engagement element 612*b* or 612*c*), the stopping element 618*a* will engage the second engagement element 612*b* or 612*c* to maintain the first raised member 604 in an area substantially above the second engagement element 612*b* or 612*c*. In this manner, the raised members 604 may be positioned and repositioned along the support member 602 to optimize the massaging characteristics of the apparatus 600.

As used herein, the stopping elements 618 and the engagement elements 612 may be interchangeable and therefore, the position of the detent balls and grooves may be reversed. For example, in one embodiment, the cylindrical tube of the support member 602 may include a plurality of detent balls (substantially similar to the stopping elements 618) positioned on the support surface 606 of the support member 602. Each detent ball may be engageable with a groove disposed within the inner surface 616 of the raised member 604. In such an embodiment, engagement between at least one detent ball and the groove disposed within the inner surface 616 of the raised member 604 maintains the raised member 604 in a discrete position along the support member 602. In this embodiment, the raised member 604 may also be repositionable along the support surface 606 of the support member 602 to engage a second detent ball (not shown) with the groove disposed within the inner surface 616 of the raised member 604. Engagement between the second detent ball and the groove disposed within the inner surface 616 of the raised member 604 maintains the raised member 604 in a second discrete position along the support member 602.

As discussed above, in certain embodiments, the apparatus 600 includes at least two raised members 604, a first raised member 604*a* and a second raised member 604*b*. In one embodiment, the diameter of the inner surfaces 616 of both of the raised members 604 is substantially the same. That is, in certain embodiments, the inner surfaces 616 of the raised members 604 are sized to receive the support surface 606 of the support member 602. In an exemplary embodiment, the outer surfaces 614 of the raised members 604 have dissimilar circumferences. For example, in one embodiment, the outer surface 614*b* of the second raised member 604*b* is substantially larger than the diameter of the outer surface 614*a* of the first raised member 604*a*. In embodiments where the apparatus 600 includes three (3) or more raised members 604, each of the raised members 604 may have an outer surface 614 of differing diameters. In other embodiments, two or more of the raised members 604 may have outer surfaces 614 having the same diameter.

The different diameters of the outer surfaces 614 of the raised members 604 allows a user to alternate the size of the raised members 604 to customize the massaging characteristics of the apparatus 600. Additionally, in certain embodiments, the first raised member 604*a* and the second raised member 604*b* are independently repositionable along the support surface 606 of the support member 602 in the lengthwise direction to allow a user to adjust the size and a number of gaps between each of the raised members 604 to further customize the massaging characteristics of the apparatus 600.

FIG. 8 depicts a perspective view of one embodiment of a raised member 604 in accordance with the present subject matter. The raised member 604 depicted in FIG. 8 is representative of either the first raised member 604*a* or the second raised member 604*b* discussed above with reference to FIGS. 6 and 7. The inner surface of raised member 604 encircles the support surface 606 of the support member 602. The outer surface 614 of the raised member 604 extends axially away from the support surface 606 of the support member 602.

In certain embodiments, the raised member 604 includes an insert 802 positioned within a pliable surround 804. In such an embodiment, the inner surface 616 of the raised member 604 is actually an inner surface of the insert 802. The insert 802 may be made of any material suitable to support a user (i.e., plastic, metal, wood, etc.). In one embodiment, the insert 802 may include a plurality of fins 806 positioned circumferentially around the inner surface 616 of the insert 802 and that extend axially away from the inner surface 616 of the insert 802.

The fins 806 support an outer support surface 808 upon which the pliable surround 804 is positioned. In one embodiment, a detent ball assembly 810 extends through the insert 802 from the outer support surface 808 to the inner surface 616. The detent ball assemble includes a biasing element 812 (i.e., a spring) and a spherical element 814. In certain embodiments, the biasing element 812 biases the spherical element 814 away from the outer support surface 808 such that the spherical element 814 extends at least partially beyond the inner surface 616 of the insert 802 to allow the spherical element 814 to interact with the engagement elements 612 to maintain the position of the raised member 604 as discussed above.

The pliable surround 804, in certain embodiments, is made of a material having a durometer sufficient to support a user. In one embodiment, the material of the pliable surround 804 is soft enough to comfortably support the user. For example, in certain embodiments, the pliable surround may be a rubber material, a foam material or any other material suitable for comfortably supporting a user. In an exemplary embodiment, the apparatus 600 may include raised members 604 having pliable surrounds 804 made of differing material having differing durometers such that the user may further customize the massaging characteristics of the apparatus 600.

Figure 9:
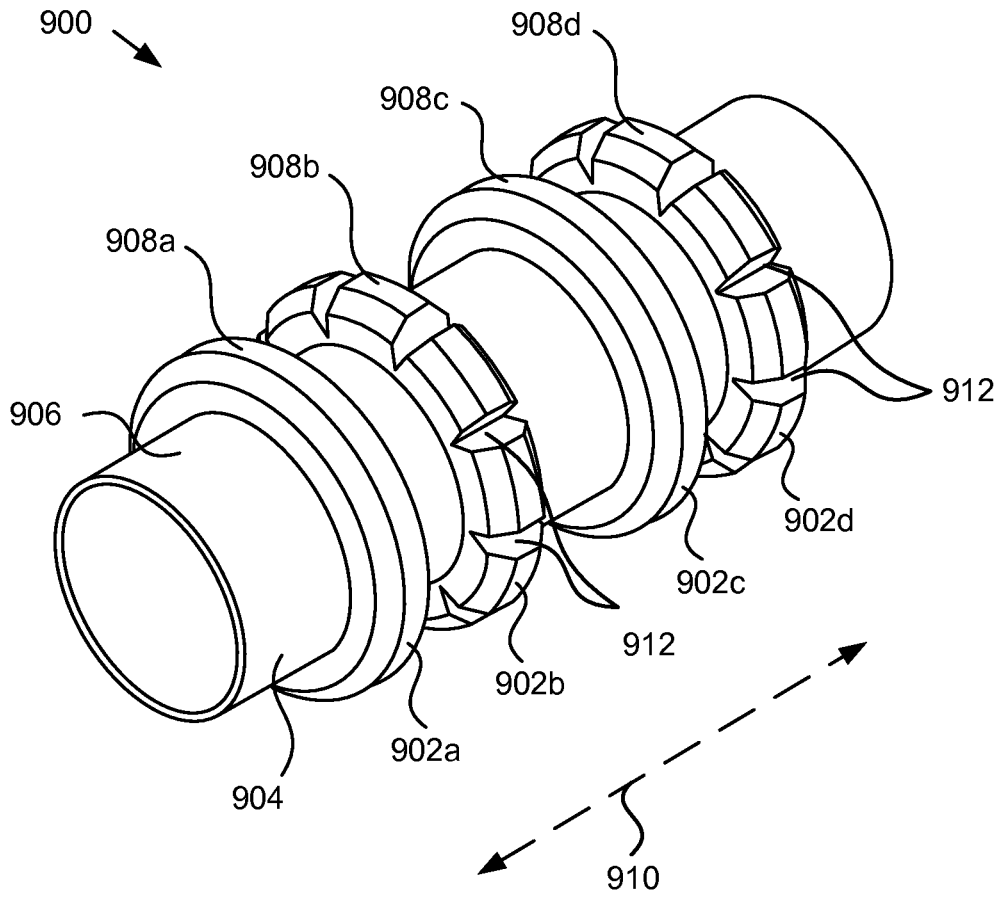
FIG. 9 depicts a perspective view of one embodiment of an apparatus for manipulating soft tissue having interchangeable raised members in accordance with the present subject matter.

FIG. 9 depicts a perspective view of one embodiment of an apparatus 900 for manipulating soft tissue having interchangeable raised members 902 in accordance with the present subject matter. In certain embodiments, the apparatus 900 includes a support member 904 about which one or more raised members 902 are positioned.

In certain embodiments, the support member 904 is a substantially cylindrical tube having an outer surface 906 configured to support one or more of the raised members 902. In other embodiments, the support member 904 may be a substantially solid column rather than a cylindrical tube. In yet another embodiment, the outer surface 906 of the support member 904 may have an alternative shape (i.e., triangular, square, octagonal, etc.)

The outer surface 906 of the support member 904 supports the raised members 902. In certain embodiments, the raised members 902 may all include outer surfaces 908 that are substantially the same. In other embodiments, such as the embodiment illustrate in FIG. 9, the outer surface 908 of one of the raised member 902 may be substantially different than the outer surface 908 of at least one other raised member 902.

For example, the outer surfaces 908*a* and 908*c* of raised members 902*a* and 902*c* are substantially different than the outer surfaces 908*b* and 908*d* of raised members 902*b* and 902*d*. The different outer surfaces 908 of each of the raised members 902 allows for each raised member to impart a unique massaging effect. While the embodiment illustrated in FIG. 9 depicts only two alternative outer surfaces 908 for the raised members 902, one of skill in the art will recognize that multiple shapes may adorn the outer surfaces 908 of the raised members 902.

The raised members 902, in one embodiment, are repositionable along the support member 904 in the direction indicated by arrow 910. By repositioning the raised members 902 along the support member 904, a user can customize the massaging characteristics of the apparatus 900. For example, if a user has a particularly painful set of muscles on one side of their body, the user may wish to position a raised member 902 having a deeper massaging characteristic on that side or the user's body. For instance, raised member 902*b* or 902*d* include a plurality of voids 912 extending longitudinally across the raised member 902*b* or 902*d*. The voids 912 and the outer surface 908 created a rippled effect on the raised members 902*b* and 902*d* which may impart a deeper massaging characteristic in tissues which come in contact with raised members 902 having such voids 912.

In certain embodiments, the raised members 902 may include a cooling substance disposed within the raised members 902. For example, in one embodiment, each raised members 902 includes a void or channel disposed within the raised members 902. In such an embodiment, a refrigerant gel or liquid is disposed within the void. The refrigerant gel or liquid may be cooled by conventional means such as by placing the raised member 902 in a freezer, refrigerator, cooler, or other cooling device for a period of time. In one embodiment, the cooling substance may include water and ammonium nitrate or other substance which can produce a cooling effect through an endothermic bond-forming reaction to cool the raised member 902.

In other embodiments, the raised members 902 may include a heating substance disposed within a void in the raised members 902. In such an embodiment, the heating substance may be heated by conventional means such as by placing the raised members 902 in hot or boiling water, a microwave oven, a conventional oven, or other heating device for a period of time. In certain embodiments, the heating substance may include sodium acetate or other substance which can produce heat through an exothermic bond-forming process. Because the raised members 902 are removable, the raised members 902 can be removed from the apparatus 900 to easily heat or cool the raised members 902 as desired.

Figure 10:
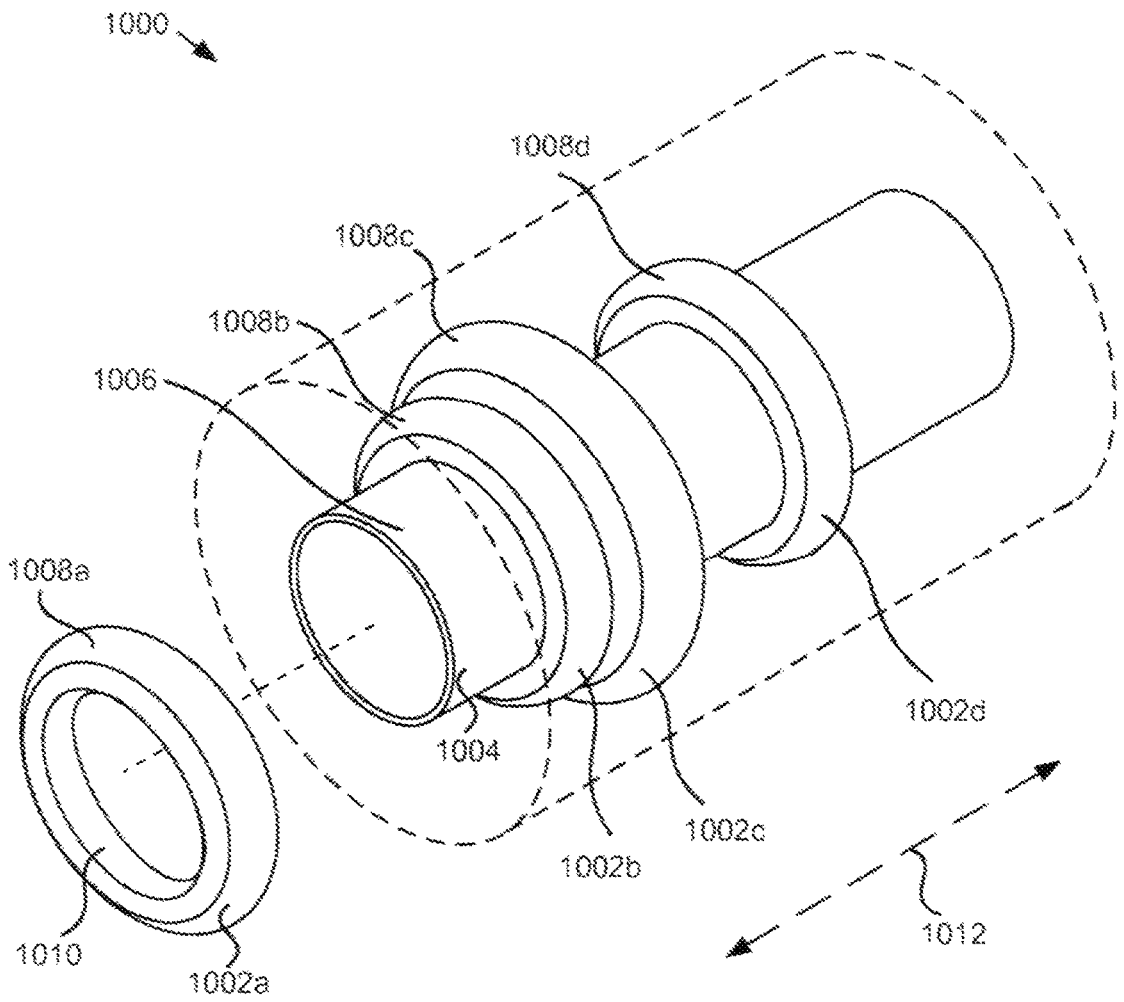
FIG. 10 depicts a perspective view of one embodiment of an apparatus for manipulating soft tissue having interchangeable raised members in accordance with the present subject matter.

FIG. 10 depicts a perspective view of one embodiment of an apparatus 1000 for manipulating soft tissue having interchangeable raised members 1002 in accordance with the present subject matter. The apparatus 1000, in certain embodiments, is substantially similar to the apparatus 900 discussed above with reference to FIG. 9. Thus, in one embodiment, the apparatus 1000 includes a support member 1004 and a plurality of raised members 1002.

In certain embodiments, the apparatus 1000 may differ from apparatus 900 in that the raised members 1002 have a uniform outer surface 1008. That is, in one embodiment, each raised member 1002 may have a toroidal or doughnut like shape as depicted in FIG. 10.

In one embodiment, the inner diameter 1010 of each raised member 1002 is sized to receive the outer surface 1006 of the support member 1004. In such an embodiment, the inner diameter 1010 of the raised members 1002 should provide a tight enough fit to grip the support member 1006 and resist movement of the raised members 1002 in the direction indicated by arrow 1012. However, because the raised members 1002 are designed to be interchangeable, the inner diameter 1010 of the raised members 1002 is sufficiently loose to allow the user to reposition or replace a particular raised member 1002 on the support member 1004.

While the inner diameters 1010 of each of the raised members 1002 are substantially the same size, in certain embodiments, the diameter of the outermost surfaces 1008 may vary to provide differing amounts of pressure along a user's soft tissue. For example, in the embodiment illustrated in FIG. 10, raised members 1002*a*, 1002*b*, and 1002*d* have outermost surfaces 1008*a*, 1008*b*, and 1008*d* that are substantially smaller in diameter than the outermost surface 1008*c* of raised member 1002*c*. By arranging the larger and smaller diameter raised members 1002 along the support member 1004, the user can apply more or less pressure to their soft tissues.

In the embodiment illustrated in FIG. 10, the raised members 1002 are depicted as having two different sized outermost surfaces 1008. One of skill in the art will recognize that in other embodiments, the raised members 1002 may have a plurality of different sized outermost surfaces 1008. Additionally, in the embodiment illustrated in FIG. 10, there are only four raised members 1002 depicted as being positionable on the support member 1004. In other embodiments, the apparatus 1000 may include a more or less than four raised members 1002.

In one embodiment, each raised member 1002 is individually covered in with a soft material such as foam or rubber to provide a comfortable massage to the user. In one embodiment, the soft material covering each raised member 1002 may be varied to provide customized massaging characteristics. For example, in certain embodiments, the material covering raised member 1002*c* may be substantially softer than the material covering raised members 1002*b* and 1002*d*. One of skill in the art will recognize that a relatively softer covering will provide a softer massaging characteristic than a harder covering. Because the raised members 1002 are interchangeable, the user can customize the massaging characteristic of the apparatus 1000.

In certain embodiments, the apparatus 1000 also includes a sleeve 1014 that is positionable over the raised members 1002 to cover the raised members 1002. The sleeve 1014 is also made of a soft material such as foam or rubber. The sleeve 1014, in certain embodiments, may incorporate a heating material or a cooling material such as the heating and/or cooling materials discussed above.

In yet another embodiment, each raised member 1002 is individually covered in with a soft material and the apparatus 1000 includes a sleeve 1014 that covers the raised members 1002. The soft material covering the raised members 1002 and/or the soft material of the sleeve 1014 cushions the user's body when the user rolls or lies on the apparatus 1000.

Figure 11:
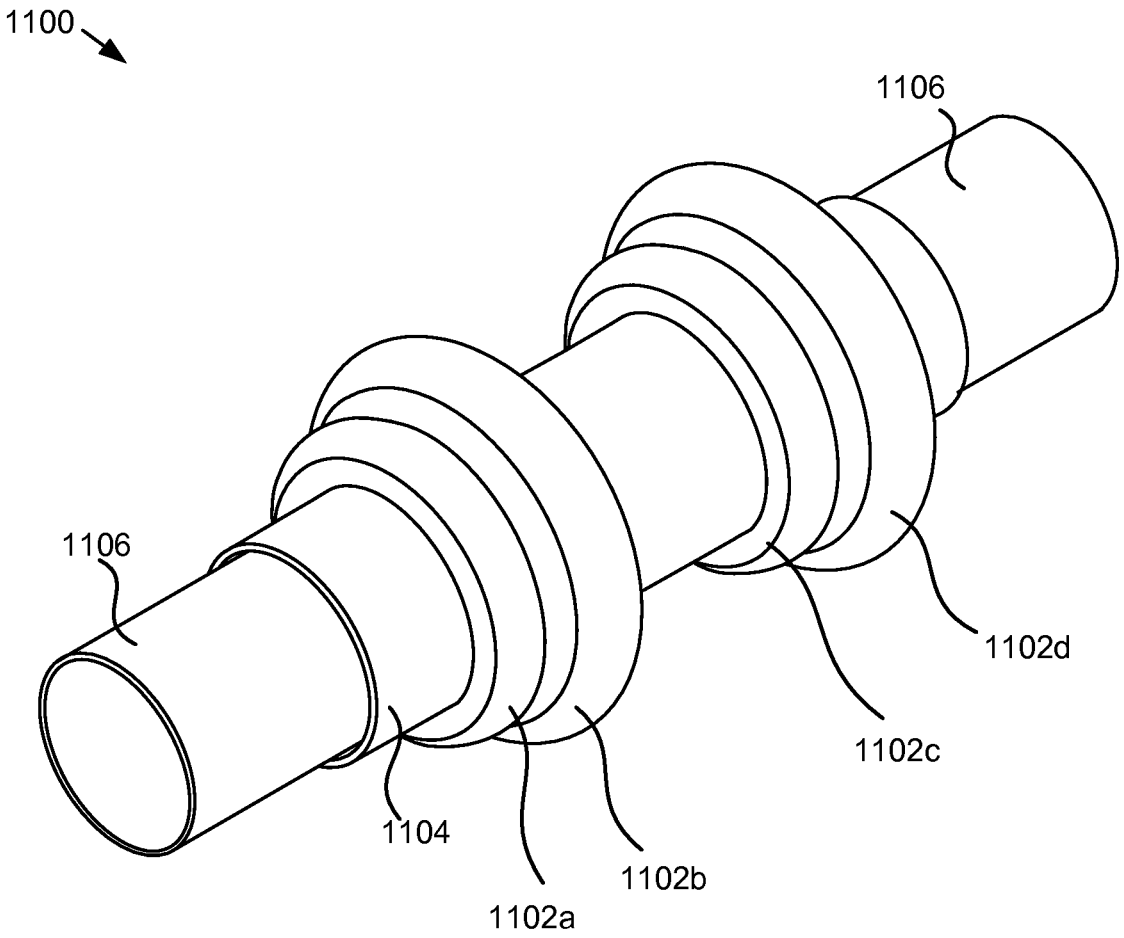
FIG. 11 depicts a perspective view of one embodiment of an apparatus for manipulating soft tissue having a rolling member in accordance with the present subject matter.

FIG. 11 depicts a perspective view of one embodiment of an apparatus 1100 for manipulating soft tissue having a rolling member 1106 in accordance with the present subject matter. The apparatus 1100, in certain embodiments, is substantially similar to apparatus 900 and apparatus 1000 discussed above with reference to FIGS. 9 and 10. Thus, in one embodiment, the apparatus 1100 includes a support member 1104 and a plurality of raised members 1102.

In one embodiment, the support member 1104 is a cylindrical tube about which the raised members 1102 are positioned. A rolling member 1106 is positioned within an inner diameter 1108 of the support member 1104. The support member 1104 rotates about the rolling member 1106 to allow the support member to roll along a user's back or other soft muscle tissue. The rolling member 1106 extends beyond the ends of the support member 1104 such that a user can grasp the rolling member 1106 at each end.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus for manipulating soft tissue, the apparatus comprising:

a support member having a support surface disposed between a first end of the support member and a second end of the support member, the support member elongated in a lengthwise direction between the first end of the support member and the second end of the support member; and at least two raised members each having an outer surface disposed opposite an inner surface, the inner surface supportable by the support surface of the support member, the outer surface of the raised members configured to rotate along at least a portion of a user's body in response to movement of the raised members along the user's body;

wherein the raised members are independently repositionable along the support surface of the support member in the lengthwise direction between the first end of the support member and the second end of the support member;

wherein the at least two raised members define at least one gap between the raised members, the size of the gap being adjustable without removing the raised members from the support member:

wherein the support member comprises a plurality of grooves and each of the raised members comprises a detent, the detent of each of the raised members engaging one of the plurality of grooves to maintain each of the raised members in a discrete position along the length of the support member.

2. The apparatus of claim 1, wherein the support member comprises a substantially cylindrical tube extending in the lengthwise direction.

3. The apparatus of claim 2, wherein each raised member is repositionable along the support surface of the support member to engage the at least one detent with a second groove disposed about the support surface of the support member, wherein engagement between the at least one detent and the second groove disposed about the support surface of the support member maintains each of the raised members in a second discrete position along the support member.

4. The apparatus of claim 3, wherein the at least two raised members comprise a first raised member and a second raised member, wherein the outer surface of the second raised member comprises a diameter substantially larger than a diameter of the outer surface of the first raised member.

5. The apparatus of claim 4, wherein the first raised member is repositionable along the support surface of the support member in the lengthwise direction independently from the second raised member.

6. The apparatus of claim 5, wherein the first raised member encircles the support surface of the support member and extends axially away from the support surface of the support member, wherein the second raised member encircles the support surface of the support member and extends axially away from the support surface of the support member.

7. An apparatus for manipulating soft tissue, the apparatus comprising:

a support member having a support surface disposed between a first end of the support member and a second end of the support member, the support member elongated in a lengthwise direction between the first end of the support member and the second end of the support member and having a plurality of grooves disposed on the support surface;

a first raised member having an outer surface disposed opposite an inner surface, the inner surface supportable by the support surface of the support member, the inner surface having a detent; and a second raised member having an outer surface disposed opposite an inner surface, the inner surface of the second raised member supportable by the support surface of the support member, the inner surface having a detent;

wherein the detent of the first raised member engages one groove of the plurality of grooves on the support member and the detent of the second raised member engages another groove of the plurality of grooves on the support member to maintain the raised members in a discrete position along the support member, and the first raised member and the second raised member are independently repositionable along the support surface of the support member in the lengthwise direction between the first end of the support member and the second end of the support member.

8. The apparatus of claim 6, wherein the outer surface of the second raised member comprises a diameter substantially larger than a diameter of the outer surface of the first raised member.

9. The apparatus of claim 6, wherein the support surface includes at least one engagement element and wherein the inner surface of the first raised member comprises at least one stopping element and the inner surface of the second raised member comprises at least one stopping element, the at least one engagement element comprising an element selected from a groove and a detent ball, the at least one stopping element of the first raised member and the at least one stopping element of the second raised member selected from the other of the groove and the detent ball.

10. The apparatus of claim 9, wherein the at least one engagement element is engageable with the at least one stopping element of the first raised member and the at least one stopping element of the second raised member to maintain the first raised member and the second raised member in discrete positions along the support member.

11. The apparatus of claim 6, wherein the support member comprises a substantially cylindrical tube extending in the lengthwise direction, the cylindrical tube including a plurality of circumferential grooves disposed about the support surface of the support member, each groove engageable with at least one detent ball positioned within the inner surface of at least one of the first raised member and the second raised member, wherein engagement between the at least one detent ball and one of the circumferential grooves disposed about the support surface of the support member maintains at least one of the first raised member and the second raised member in a discrete position along the support member.

12. An apparatus for manipulating soft tissue, the apparatus comprising:

a support member having a support surface disposed between a first end of the support member and a second end of the support member, the support member elongated in a lengthwise direction between the first end of the support member and the second end of the support member, wherein the support surface includes at least a first groove and a second groove;

a first raised member having an outer surface disposed opposite an inner surface, the inner surface supportable by the support surface of the support member, wherein the inner surface of the first raised member comprises at least one detent; and a second raised member having an outer surface disposed opposite an inner surface, the inner surface of the second raised member supportable by the support surface of the support member, wherein the inner surface of the second raised member comprises at least one detent;

wherein the first raised member and the second raised member are independently repositionable along the support surface of the support member in the lengthwise direction between the first end of the support member and the second end of the support member and wherein the at least one detent of the first raised member is engageable with the first groove and the at least one detent of the second raised member is engageable with the second groove of the support member to maintain the first raised member and the second raised member in discrete positions along the length of the support member.

13. The apparatus of claim 12, wherein the outer surface of the second raised member comprises a diameter substantially larger than a diameter of the outer surface of the first raised member.

* * * * *